US006530108B1

(12) United States Patent
Brown et al.

(10) Patent No.: US 6,530,108 B1
(45) Date of Patent: Mar. 11, 2003

(54) DUSTING MITT

(75) Inventors: Colin W. Brown, Egham (GB); Edward Francis, Franksville, WI (US); Jeffrey Fujimoto, Chicago, IL (US); Richard Graceffa, Racine, WI (US); James Nielsen, Racine, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 09/606,694

(22) Filed: Jun. 30, 2000

(51) Int. Cl.[7] ..... A47L 13/40; A47L 13/18
(52) U.S. Cl. ..... 15/227; 15/1.51
(58) Field of Search ..... 15/1.51, 227; D28/63

(56) References Cited

U.S. PATENT DOCUMENTS

| | | | | |
|---|---|---|---|---|
| 720,955 | A | | 2/1903 | Oberseider, Jr. |
| 1,113,870 | A | | 10/1914 | Billings |
| 1,478,914 | A | * | 12/1923 | Ritzenthaler |
| 1,528,026 | A | * | 3/1925 | Pease |
| 1,782,502 | A | * | 11/1930 | Crane |
| 1,882,179 | A | | 10/1932 | Daly |
| 2,239,919 | A | | 4/1941 | Lindfelt |
| 2,364,749 | A | | 12/1944 | O'Connell |
| 2,643,388 | A | | 6/1953 | Curtis |
| 2,795,806 | A | * | 6/1957 | Suttles |
| 2,880,436 | A | * | 4/1959 | Hayden |
| 2,884,644 | A | | 5/1959 | Jefferson |
| 3,144,671 | A | | 8/1964 | Gould |
| 3,608,708 | A | * | 9/1971 | Storandt |
| 3,711,889 | A | | 1/1973 | Jennings |
| 3,982,298 | A | | 9/1976 | Ota |
| D258,625 | S | | 3/1981 | Sheridan |
| 4,305,173 | A | | 12/1981 | Isao |
| D277,050 | S | | 1/1985 | Bruseloff |
| 4,507,803 | A | | 4/1985 | Ryan et al. |
| 4,525,411 | A | | 6/1985 | Schmidt |
| 4,660,228 | A | | 4/1987 | Ogawa et al. |
| 4,788,733 | A | * | 12/1988 | Lerner |
| 4,964,188 | A | | 10/1990 | Olson |
| 5,010,617 | A | * | 4/1991 | Nelson |
| 5,473,789 | A | * | 12/1995 | Oster |
| D365,896 | S | | 1/1996 | Zuege |
| 5,525,397 | A | | 6/1996 | Shizuno |
| 5,564,154 | A | | 10/1996 | Cohn, III |
| 5,649,336 | A | | 7/1997 | Finch et al. |
| 5,829,089 | A | | 11/1998 | Steadman |
| 5,878,439 | A | | 3/1999 | Waters, Jr. |
| 5,894,623 | A | | 4/1999 | Thill |
| 5,924,153 | A | | 7/1999 | Salley |
| 5,924,160 | A | | 7/1999 | Bradley |
| 6,024,970 | A | | 2/2000 | Woodard |

FOREIGN PATENT DOCUMENTS

| | | |
|---|---|---|
| DE | 811030 | 9/1997 |
| EP | 0848 927 A1 | 12/1997 |
| FR | 2679115 | 7/1991 |
| GB | 2 061 709 | 10/1979 |
| GB | 2 289 405 A | 5/1995 |

* cited by examiner

*Primary Examiner*—Terrence R. Till

(57) ABSTRACT

A mitt worn on a hand for cleaning. The mitt includes a section for the palm of the hand, a section for the fingers, and a compartment on either side of a central axis of the mitt for a thumb. The mitt is capable of being used on either hand, and both sides of the mitt may be used without moving the mitt from one hand to the other. The mitt is formed using an electrostatically-charged material to optimize cleaning efficiency. Also disclosed is a method of forming a mitt for cleaning.

11 Claims, 3 Drawing Sheets

DUSTING MITT

BACKGROUND OF THE INVENTION

1. Field of the Invention

The present invention relates generally to a mitt worn on a hand for use in cleaning, and in particular to a mitt for cleaning that is formed from an electrostatically-charged fabric. The mitt has a compartment for a thumb on either side of a central axis of the mitt, allowing the mitt to be used on either hand. The present invention also relates to a method of producing such a mitt.

2. Description of the Related Art

Mitts for dusting and cleaning have typically had several disadvantages. A common problem with prior mitts is the inability to use both sides of the mitt for cleaning without removing the mitt from one hand and placing it on the opposite hand. This is inconvenient because users typically prefer to place the mitt on their dominant hand for cleaning, so it is awkward to move the mitt to the other hand to allow use of both cleaning surfaces of the mitt. Typically, those mitts that were able to be used on either hand and were also capable of having both surfaces of the mitt used for cleaning had no separate thumb compartment, which led to difficulty in controlling the mitts. Another problem with prior dusting and cleaning mitts is the lack of their efficiency in picking up and retaining dirt, which was frequently only shifted from one place to another.

Accordingly, there is a need in the art for a cleaning mitt that can be used on either hand, and allows both cleaning surfaces to be used. Such a mitt should provide separate compartments for the thumb, in order to provide greater control during cleaning. Further, the mitt should be made of a material that attracts and traps dust and dirt to prevent it from being scattered.

SUMMARY OF THE INVENTION

The present invention addresses the foregoing needs in the art by providing a mitt for dusting and cleaning, and a method of forming such a mitt.

In a first aspect of the present invention, a mitt for cleaning comprises an opening for inserting a hand therein, a section for the palm of the hand, a section for fingers, and a compartment for a thumb on either side of a central axis of the mitt, wherein the mitt may be used on either hand.

In another aspect, the present invention includes a method of forming a mitt for cleaning, comprising forming an opening for inserting a hand therein, forming a section for the palm of the hand, forming a section for fingers, and forming a compartment for a thumb on either side of a central axis of the mitt, such that the mitt may be used on either hand. Preferably, the mitt is formed from an electrostatically-charged material.

A better understanding of these and other objects, features, and advantages of the present invention may be had by reference to the drawings and to the accompanying description, in which there are illustrated and described preferred embodiments of the invention.

BRIEF DESCRIPTION OF THE DRAWINGS

Throughout the figures, like or similar reference numerals have been used for like or corresponding parts.

DESCRIPTION OF THE PREFERRED EMBODIMENTS

For illustrative purposes, the preferred embodiment of a mitt for cleaning and a method of forming a mitt for cleaning according to the present invention are described in connection with FIGS. 1 through 3.

Figure 1:
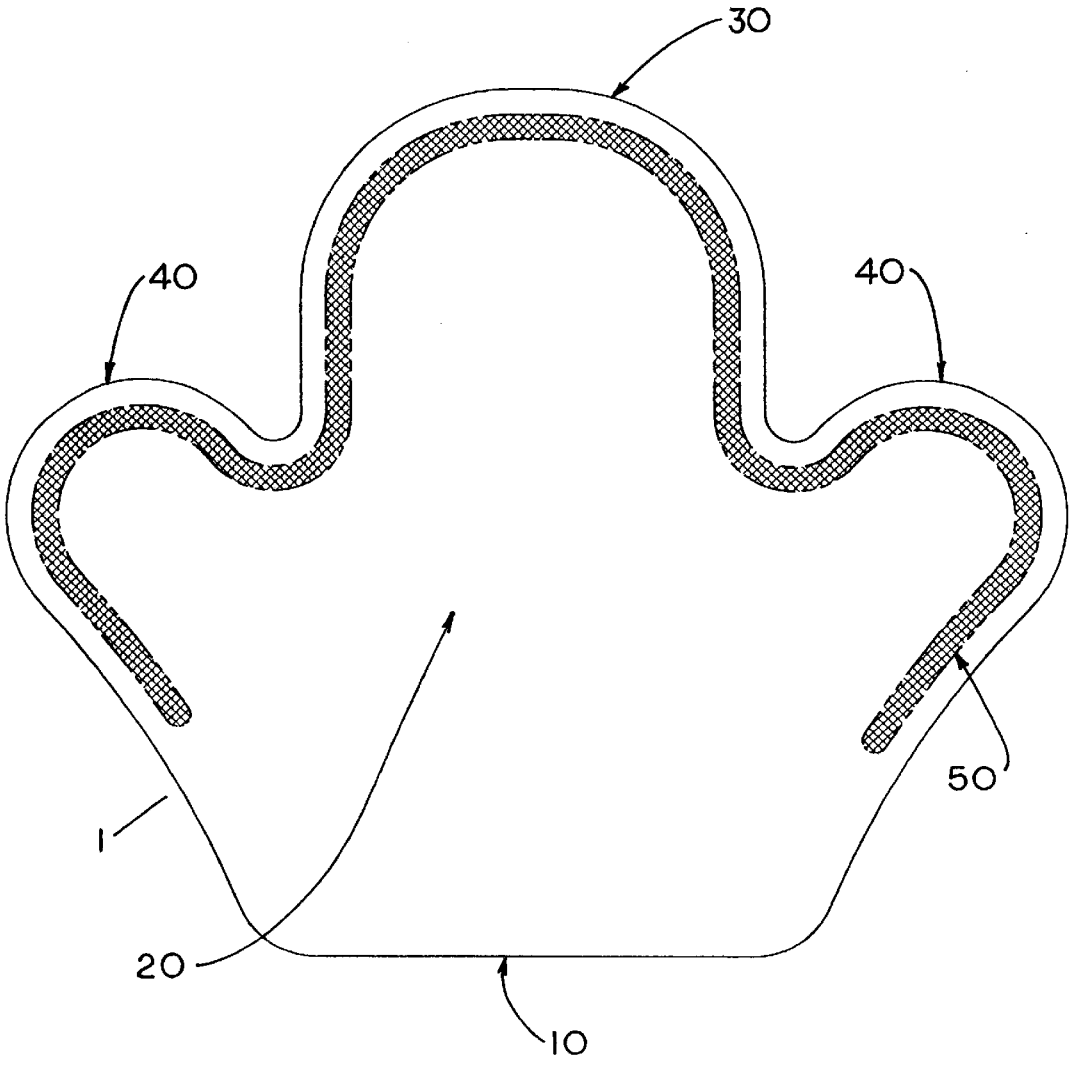
FIG. 1 is a front view of a dusting mitt according to a first embodiment of the present invention.

Referring to FIG. 1, the dusting and cleaning mitt 1 of this embodiment of the present invention is formed from, for example, two pieces of a material suitable for use in cleaning household surfaces such as wood, linoleum, tile, and other hard surfaces. Of course, the invention is not limited to the use of two pieces of material. Preferably, the material is able to attract and retain common household dirt, such as dust, hair, dander, etc. The material should also leave behind very little lint on the surface to be cleaned.

According to the preferred embodiment of the present invention, the material used to form the dusting mitt is a triboelectric or electrostatically-charged fabric that may be woven or non-woven. The material may be a natural or synthetic fabric, or a paper product, provided that it has been imparted with an electrostatic charge that causes the material to attract dirt. An especially preferred material is described in U.S. Pat. No. 5,525,397, which is incorporated herein by reference in its entirety.

According to the preferred embodiment, the two pieces of fabric are cut in a shape that is symmetrical about a central axis (not shown) of the mitt 1, which runs from the top of finger area 30 to an opening 10 for the hand. The symmetrical shape is not a requirement for practicing our invention, but it simplifies forming the mitt and we have found is more appealing to the consumer. According to our embodiment, the pieces of material are in the shape of a mitten having a thumb compartment 40 on each side of the central axis. As will be demonstrated with respect to FIGS. 2 and 3, it is possible for the pieces to have a variety of other shapes, as long as an area 30 for the fingers and two compartments 40 for a thumb are provided.

The mitt 1 is formed by placing the two pieces of material together, and bonding them together (shown schematically by reference numeral 50) to produce the opening 10 for a hand, an area 20 for the palm of the hand, an area 30 for the fingers, and a compartment 40 for the thumb on either side of the central axis of the mitt 1. In forming the mitt 1, it is not critical whether the fabric is cut into the desired shape before or after the bonding step. It is also possible that the bonding and cutting steps can be carried out simultaneously.

The bonding 50 is preferably approximately in the shape of a hand having a thumb compartment 40 on each side of the central axis. The bonding 50 is performed, for example, by heat-sealing the two pieces of material together (according to the preferred embodiment), but it may also be done by ultrasonic welding, gluing, or sewing the two layers of material together, or by any other process that results in the two pieces of fabric becoming attached together. The bonding 50 may be in any design that roughly approximates the shape of a mitten having two thumb compartments 40.

The drawings show the bonding 50 being recessed from the edges of the mitt 1. This, however, is not limiting. In fact, where appropriate, the bonding may be provided at the edges along selected portions of the perimeter of the mitt, if desired. Also, where provided, the bonding may be continuous, or it may be discontinuous as long as the pieces of material are appropriately secured together. This is true for each of the embodiments.

By forming two compartments 40 for the thumb in the mitt 1, the mitt 1 can be used on either hand, and both of the surfaces of the mitt 1 can be used to collect and trap dust and dirt. This design is beneficial because it allows the consumer to use the mitt 1 on his or her dominant hand by inserting that hand into the mitt 1 and inserting a thumb into one of the two compartments 40 for the thumb. This design also makes it possible for the consumer to use both cleaning surfaces of the mitt 1 simply by rotating the mitt 1 one hundred eighty degrees with respect to the center line of the mitt 1, which runs from the area 30 for the fingers to the opening 10 for inserting the hand. The consumer then re-inserts the dominant hand into the mitt 1, and places the thumb into the second of the two compartments 40 for the thumb, and then continues cleaning.

The area 30 for the fingers is kept open according to the preferred embodiment. This allows the consumer a greater degree of freedom in using the mitt 1 to clean irregularly shaped surfaces. However, it is also possible to provide separate areas for each finger by bonding the material together to form, for example, four individual finger areas.

Figure 2:
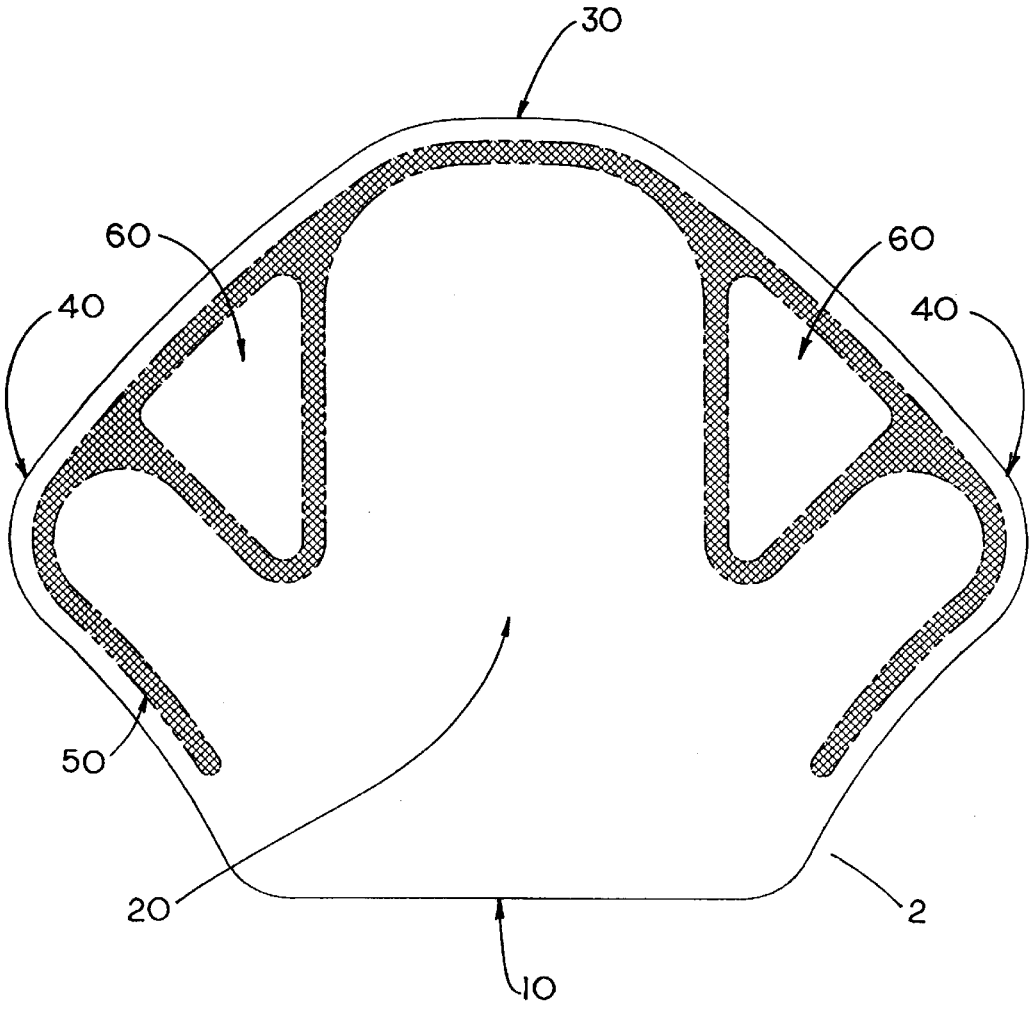
FIG. 2 is a front view of a dusting mitt according to another embodiment of the present invention.

Turning to FIG. 2, the mitt 2 is formed from, for example, two pieces of material roughly shaped like a mitten with two compartments 40 for a thumb, in which the sections 60 between the thumb compartments 40 and the area 30 for the fingers are connected. The opening 10 for the hand, and the area 20 for the palm, the area 30 for the fingers, and the compartments 40 for the thumb are formed by bonding the material together as shown by reference numeral 50. The bonding is preferably performed to form the mitt 2 into the shape of a mitten having a compartment 40 for a thumb on either side of the central axis of the mitt 2, with additional bonding 50 connecting the areas 60 between the compartments 40 for a thumb and finger area 30.

This shape of the mitt 2 in this embodiment is beneficial in that it is easier to mass produce due to its simple shape, and results in less waste of fabric, which is otherwise caused by removing the areas 60 between the compartments 40 for a thumb and finger area 30.

Figure 3:
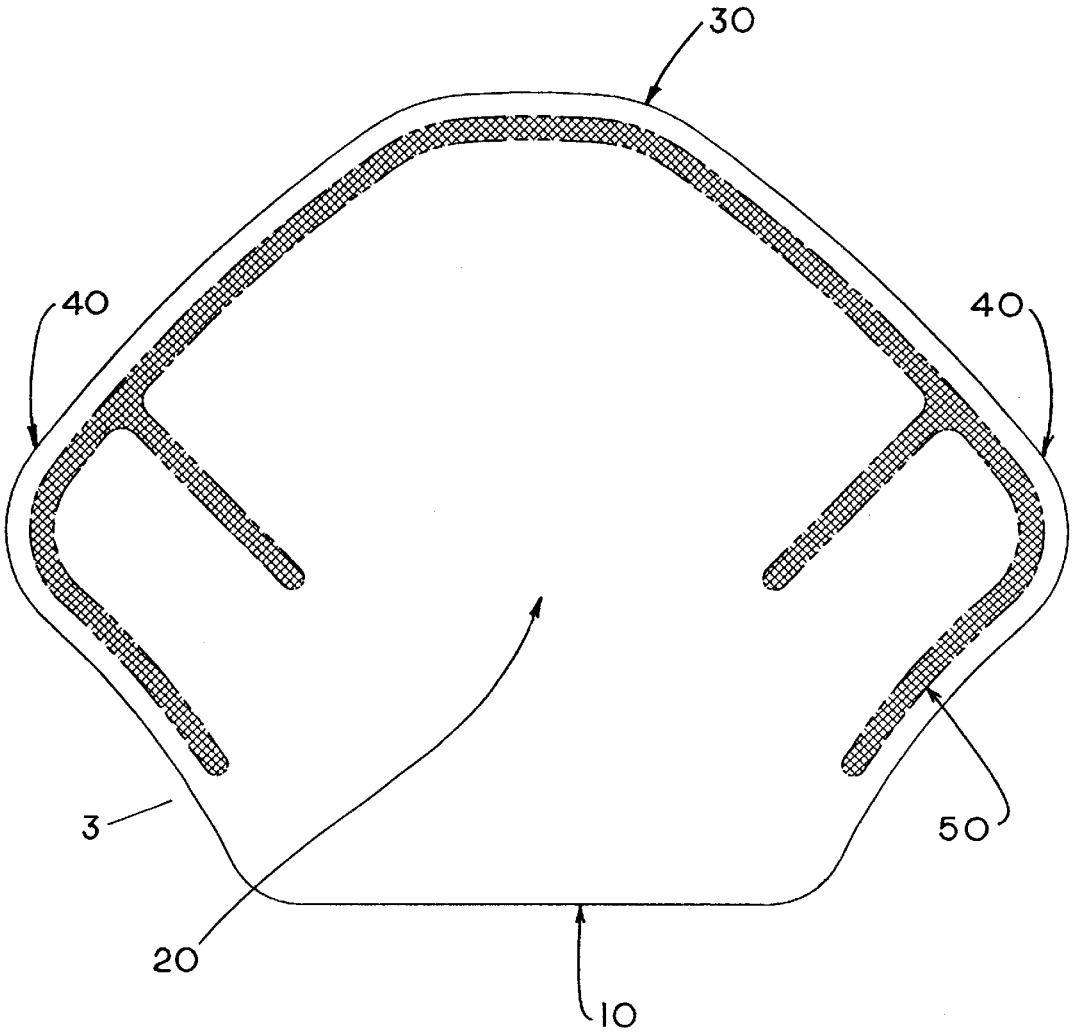
FIG. 3 is a front view of a dusting mitt according to yet another embodiment of the present invention.

As best seen in FIG. 3, the mitt 3 may be produced in an even more simple and cost-effective manner by utilizing a similar shape as the mitt 2 shown in FIG. 2, while using less bonding 50 to form the different areas of the mitt 3. In this embodiment, the outside edges of the material are bonded together, leaving an opening 10 for a hand to be inserted. Then, a compartment 40 for a thumb is formed on either side of a finger area 30 by bonding 50. This embodiment allows more flexibility in the overall shape of the mitt 3, and permits the mitt 3 to be designed so as to minimize the amount of fabric used.

The mitts according to our invention are preferably sized so as to accommodate the hand of an average adult. The mitts may also be provided in additional sizes to accommodate smaller or larger hands, if desired.

The dusting and cleaning mitt according to the present invention is primarily intended for use on dry, hard surfaces. The mitt may be used with products such as furniture polish to assist in dusting, but use with liquids such as glass cleaners is not recommended due to the fact that the material may absorb the liquid and bring it into contact with the consumer's hand. However, the mitt may be used with liquids if a lining is provided, and such a lining is within the concepts of the present invention.

In addition to the electrostatic or triboelectric properties of the mitt, another mechanism for removing larger particles of dirt using the mitt of the present invention involves grasping the dirt in the hand using the mitt, and then inverting the mitt while removing the mitt from the hand. This results in the larger particles of dirt becoming trapped inside the mitt, which may then be discarded. This allows the dirt to be removed without using additional apparatus such as a dust pan, and prevents the dirt from touching the hand of the consumer.

In their commercial form, the mitts of the present invention are intended to be disposable, and are provided in packs containing several mitts. The mitts are flat, allowing them to be stacked efficiently within the packaging. However, it is also possible to practice the present invention while producing a reusable, washable mitt if a durable electrostatically-charged material is used.

The embodiments discussed above are representative of embodiments of the present invention and are provided for illustrative purposes only. They are not intended to limit the scope of the present invention. Although components, materials, configurations, and means of connecting various parts have been shown and described, such are not limiting. Modifications and variations are contemplated within the scope of the present invention, which is intended to be limited only by the scope of the accompanying claims.

INDUSTRIAL APPLICABILITY

The mitts of our invention are suited for use in cleaning surfaces, and are particularly useful in dusting. The two thumb compartments allow both sides of the mitt to be used during cleaning, and also allow the mitt to be used on either hand. The electrostatically-charged fabric used to form the mitt allows for more efficient removal of-dust and dirt from surfaces. The method of forming the mitt according to our invention is a useful way to produce mitts for dusting and cleaning.

We claim:

1. A mitt for cleaning, said mitt comprising:

two cleaning surfaces, said surfaces being comprised of the same electrostatically charged material;

an opening between said surfaces for inserting a hand;

an area for a palm of the hand;

an area for fingers; and a compartment for a thumb on either side of a central axis of the mitt, whereby the mitt may be used on either hand.

2. The mitt according to claim 1, wherein the mitt is symmetrical about the central axis, which extends from the area for the fingers through the opening for inserting a hand.

3. The mitt according to claim 1, wherein the electrostatically charged material is a woven fabric.

4. The mitt according to claim 1, wherein the electrostatically charged material is a non-woven fabric.

5. The mitt according to claim 1, wherein the areas for the fingers and each compartment for the thumb are separated by an area of bonded fabric.

6. The mitt according to claim 5, wherein the area of bonded fabric is formed by a method selected from the group consisting of heat sealing, ultrasonic welding, sewing, and gluing.

7. A method for producing a mitt for cleaning, comprising:

forming an opening for inserting a hand;

forming an area for a palm of the hand;

forming a section for the fingers; and forming a compartment for a thumb on either side of a central axis of the mitt, such that the mitt may be used on either hands, whereby said mitt comprises two cleaning surfaces formed of electrostatically charged material.

8. The method of claim 7, wherein the mitt is symmetrical about the central axis, which extends from the section for the fingers through the opening for inserting a hand.

9. The method of claim 7, wherein the electrostatically-charged material is a woven fabric.

10. The method of claim 7, wherein the electrostatically-charged material is a non-woven fabric.

11. The method of claim 7, further comprising forming the sections of the mitt by a method selected from the group consisting of heat sealing, ultrasonic welding, sewing, and gluing.

* * * * *